US006273834B1

(12) United States Patent
Winter

(10) Patent No.: US 6,273,834 B1
(45) Date of Patent: Aug. 14, 2001

(54) QUICK-RELEASE SELF-ADJUSTING LATCH FOR ADJUSTABLE BASKETBALL GOAL ASSEMBLY

(75) Inventor: David C. Winter, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 09/599,159

(22) Filed: Jun. 21, 2000

Related U.S. Application Data

(63) Continuation-in-part of application No. 09/236,817, filed on Jan. 25, 1999, now Pat. No. 6,120,396, which is a continuation-in-part of application No. 09/018,231, filed on Feb. 3, 1998, now Pat. No. 6,077,177, which is a continuation-in-part of application No. 08/986,382, filed on Dec. 8, 1997, now Pat. No. 5,879,247, which is a continuation of application No. 08/799,979, filed on Feb. 12, 1997, now Pat. No. 5,695,417.

(60) Provisional application No. 60/140,509, filed on Jun. 22, 1999.

(51) Int. Cl.[7] ..... A63B 63/08

(52) U.S. Cl. ..... 473/484; 473/483; 473/482; 473/481; 248/274.1; 248/295.11; 248/297.11

(58) Field of Search ..... 473/481, 482, 473/483, 484, 471; 248/274.1, 280.11, 281.11, 283.1, 295.11, 297.11

(56) References Cited

U.S. PATENT DOCUMENTS 4,738,487 4/1988 Shalinsky et al. ..... 297/338
5,695,417 * 12/1997 Winter et al. ..... 473/484
5,879,247 * 3/1999 Winter et al. ..... 473/484
6,077,177 * 6/2000 Winter et al. ..... 473/484
6,135,901 * 10/2000 Van Nimwegen ..... 473/484
6,142,891 * 11/2000 Winter et al. ..... 473/484
6,155,938 * 12/2000 Mower ..... 473/484
6,179,733 * 1/2001 Story ..... 473/484

* cited by examiner

*Primary Examiner*—Raleigh W. Chiu
(74) *Attorney, Agent, or Firm*—Madson & Metcalf

(57) ABSTRACT

The present invention relates to a basketball goal assembly having a quick-release, self-adjusting adjustable latch mechanism for adjusting the height of a basketball goal above a playing surface. The basketball goal assembly includes a deformable goal support structure pivotally attached at a first end of a support pole. An extension arm includes a first end pivotally connected to the goal support structure and a second opposing end having a locking tab attached thereto for selective engagement with a plurality of slots formed in relation to the support pole. An adjustment mechanism disposed in relation to the extension arm allows the position of an anchor point to be adjusted. The adjustment of the position of the anchor point selectively deforms the goal support structure, thereby adjusting the height of the basketball goal in relation to the playing surface. A counterbalance member is operably disposed in relation to the goal support structure to assist in controlling adjustment in the height of the basketball goal assembly. The adjustment mechanism may comprise a locking key selectively engageable within a series of slots formed in a track rigidly attached to a portion of the support pole.

20 Claims, 3 Drawing Sheets

QUICK-RELEASE SELF-ADJUSTING LATCH FOR ADJUSTABLE BASKETBALL GOAL ASSEMBLY

RELATED U.S. APPLICATIONS

This application claims the benefit of U.S. Provisional Application No. 60/140,509, filed Jun. 22, 1999, and entitled QUICK-RELEASE SELF-ADJUSTING LATCH FOR ADJUSTABLE BASKETBALL GOAL ASSEMBLY, and is a continuation-in-part of application Ser. No. 09/236,817, filed Jan. 25, 1999, and entitled QUICK-RELEASE LOCKING MECHANISM FOR ADJUSTABLE BASKETBALL GOAL SYSTEM AND METHODS FOR USING SAME, now issued as U.S. Pat. No. 6,120,396 which is a continuation-in-part of our patent application Ser. No. 09/018,231, filed Feb. 3, 1998, and entitled ADJUSTABLE BASKETBALL GOAL SYSTEM, now issued as U.S. Pat. No. 6,077,177, which is a continuation-in-part of application Ser. No. 08/986,382, filed Dec. 8, 1997, and entitled POWER LIFT BASKETBALL ADJUSTMENT SYSTEM, now issued as U.S. Pat. No. 5,879,247, which is a continuation of application Ser. No. 08/799,979, filed Feb. 12, 1997, and entitled POWER LIFT BASKETBALL ADJUSTMENT SYSTEM, now issued as U.S. Pat. No. 5,695,417. The foregoing applications are hereby incorporated herein by reference.

BACKGROUND

1. The Field of the Invention

The present invention is related to apparatus and methods for adjusting the height of a basketball goal assembly and, more particularly, to novel quick-release, self-adjusting locking mechanisms that engage a retaining assembly anchored along the length of a rigid support pole, wherein the locking mechanism selectively engages the retaining assembly along the length of the retaining assembly at a plurality of defined locking positions to facilitate adjustment in the height of a basketball goal above a playing surface.

2. Technical Background

Basketball is an increasingly popular sport in the United States and abroad. There are many cities, counties, and other associations that sponsor recreational and instruction leagues where people of all ages can participate in the sport of basketball. Today there are organized leagues for children as young as five and six years old. Accordingly, it is not surprising that more and more people have a basketball goal mounted on their property.

The problem with many basketball goals is that the goal is usually fixed at a certain height above the playing surface with a standard height being about ten (10) feet. Children and younger teens, however, generally don't have the strength or agility to make a basket at a height of ten feet. Moreover, children tend to develop improper shooting skills attempting to throw a basketball toward a goal that is too high. Oftentimes, children or younger teens get frustrated with the sport of basketball and may give up the sport altogether.

Many attempts have been made by those skilled in the art to design basketball goal systems which are adjustable to several different heights. This allows persons of all ages and sizes to enjoy the sport of basketball because the basketball goal can be adjusted to various heights above the playing surface. Some of the prior art basketball goal systems employ a deformable linkage design which generally connects the backboard to a rigid mount such as a pole. In operation, prior art deformable linkages can be selectively locked at various positions to secure the basketball goal at a predetermined height above a playing surface.

One disadvantage of prior art deformable linkage devices is that the adjustment mechanism is typically positioned within or near the linkage well above the playing surface Accordingly, whenever a user desires to adjust the height of the basketball goal, the use of a ladder, stool, or the like is required to enable the user to reach the adjustment mechanism and "unlock" the basketball goal. Having to use a ladder, stool, or the like to adjust the height of the basketball goal creates an inherent danger to the user of the potential for falling.

Other prior art adjustable basketball goal systems have adjustment mechanisms that are only accessible with the use of a separate rod or pole, such as a broomstick handle. Often times, there is not such an adjustment device readily available. The user must therefore accommodate the inconvenience of having to find a suitable implement, or simply choose not to adjust the height of the basketball goal.

Adjustable basketball goals of the prior art were also developed by those skilled in the art in such a manner that the entire weight of the basketball goal bears directly on the adjustment system. One disadvantage of these prior art configurations is that it takes more strength and patience to adjust the height of the basketball goal than typical children or younger teens possess. This is unfortunate because it is usually small children or younger teens who have the greatest need to adjust the height of the basketball goal.

To overcome this problem, many basketball goal assemblies were developed that provided an adjustment mechanism having a heavy counterbalancing beam to counteract the weight of the basketball goal. Such adjustment systems are generally very bulky, expensive to manufacture and transport, and are typically difficult to assemble.

Another disadvantage of many prior art adjustable basketball goal systems is that the adjustment mechanism is generally separate and distinct from the securing apparatus. In this regard, both hands of a user are normally needed to simultaneously unlock the system, adjust the basketball goal assembly to the desired height, and then lock the adjustment assembly in a predetermined position.

Yet another disadvantage of prior art basketball goal adjustment systems is that many of the securing and adjustment mechanisms require numerous working components and a complex design configuration to be able to simultaneously adjust and secure the basketball goal assembly in a predetermined position above a playing surface. Accordingly, this generally increases the cost and difficulty of manufacture and, in addition, the time necessary for assembly of the adjustable basketball system by a user.

Another problem with various prior art adjustable basketball goal assemblies is that a user must manually lock the adjustment mechanism in place after the goal has been positioned at the desired height. If a user releases the adjustment mechanism to activate the locking mechanism, the goal may, in the meantime, rise or fall from the selected height. This release of the adjustment mechanism may interfere with convenient adjustment or even cause injury to a user or innocent bystander.

Additionally, many adjustable basketball goal assemblies lack discreet settings for adjusting the height of the basketball goal above the playing surface. Many users will wish to adjust the goal to the same height consistently to measure improvements in dunking ability or standardize game play. However, many current adjustable basketball goal systems force a user to guess how high the goal is and simply make do with any inaccuracies in the adjustment of the goal.

From the foregoing, it will be appreciated that it would be an advancement in the art to provide an adjustable basketball goal system that can be adjusted by a user standing at ground level without requiring the use of a ladder or a pole. It would be a further advancement to provide an adjustable basketball goal system that is capable of being adjusted quickly and easily with the use of a single hand of a user. A further enhancement would be to provide an adjustable basketball goal system that is "self-adjusting" and/or adjustable to various discreet height settings. Finally, it would be an advancement in the art to provide an adjustable basketball goal system that is simple in design, cost effective to manufacture and transport, and easy to assemble.

Such an adjustable basketball goal system is disclosed and claimed herein.

OBJECTS AND BRIEF SUMMARY OF THE INVENTION

The apparatus of the present invention has been developed in response to the present state of the art, and in particular, in response to the problems and needs in the art that have not yet been fully resolved by currently available adjustable basketball goal systems. Thus, it is an overall objective of the present invention to provide quick-release, self-adjusting latch mechanisms for adjustable basketball goal assemblies which overcome many or all of the shortcomings in the prior art as discussed above.

To achieve the foregoing objective, and in accordance with one presently preferred embodiment of the invention as broadly described herein, a novel adjustable basketball goal assembly is provided including a rigid support pole having a first end configured to supportably engage a basketball goal above a playing surface and a second opposing end adapted to mountably engage a support base. Structurally, the support base includes a receiving aperture formed at a first end of the support base, wherein the receiving aperture is adapted to receive and maintain the opposing second end of the support pole in either a fixed or pivotal relationship. The support base further provides sufficient weight so as to support the pole and a goal support assembly in a general upright position over a playing surface. In addition, one or more brace supports may be adapted to provide a structural connection between the base and the pole so as to assist in providing structural support to retain the pole and the attached goal support assembly in a generally upright configuration for game play.

In one presently preferred embodiment, the goal support assembly may include a backboard, a rim, a net, and upper and/or lower engagement arms pivotally connected between the backboard and the first end of the support pole. As contemplated herein, a quick-release, self-adjusting latch mechanisms may be operably disposed in relation to the upper and/or lower engagement arms of the goal support assembly such that selective manipulation of the adjustable latch mechanism results in a corresponding adjustment in the height of the goal support assembly above the playing surface, wherein any adjustment in the height of the goal support assembly above the playing surface directly corresponds to a different deformation. Specifically, the configuration of the goal support assembly allows the backboard, rim, and net of the goal support assembly to be adjusted to differing selective heights while remaining horizontally disposed in relation to the playing surface.

An extension arm is preferably disposed between the goal support structure and the support pole. In one presently preferred embodiment, the extension arm is pivotally attached at a first end to an upper and/or lower engagement arm(s) of the goal support structure and extends substantially downwardly therefrom along a back side of the support pole. A second opposing end of the extension arm is engageably disposed in relation to a track having a series of slots. Preferably, the track is rigidly attached at a point along the length of the back side of the support pole. Structurally, the second opposing end of the extension arm comprises a locking key configured to independently engage the series of slots formed in the track so as to provide a locking engagement therebetween. Preferably, the key extends from a latch affixed to the second end of the extension arm such that the key selectively engages a pair of corresponding slots of the series of spaced-apart slots formed in the track rigidly attached along the back side of the support pole. The slots provide a series of discreet settings for adjusting the height of the basketball goal above the playing surface. A user can therefore determine the selected height of the basketball goal by simply checking to see which slot engageably retains the key in locking relationship.

In one presently preferred embodiment, the deformable goal support assembly has a lower engagement arm pivotally fixed at the first end of the support pole. A leveraging extension of the lower engagement arm extends rearward from the support pole to pivotally connect to the first end of the extension arm. Thus, an adjustment in the vertical displacement of the extension arm relative to the locking engagement between the key and slots formed in the track are translated through the lower engagement arm to the goal support assembly. The goal support assembly is thereby deformed, thus altering the height of the basketball goal in relation the playing surface. Similarly, one presently preferred method of adjusting the height of the basketball goal assembly may comprise the steps of: (1) gripping a handle attached at the second end of the extension arm; (2) pulling on the handle in a direction away from the back side of the support pole to dislodge the engaging key from the corresponding slot(s); (3) slidably positioning the key adjacent to the desired slot; and (4) releasing the handle thereby introducing the key into the corresponding slot of the track and lock the extension arm in a position relative to the support pole and the goal support assembly.

The adjustable basketball goal assembly may be self-adjusting because once the handle is released, the key slides into the first available slot. In this regard, a biasing member (i.e., a spring) is preferably attached between the extension arm and the rigid support pole to facilitate a biasing force acting therebetween. As appreciated by those skilled in the art, prior art adjustable basketball goal systems typically require two separate steps to adjust the height of the goal support assembly and then lock the adjustment mechanism in place. Those steps are combined in the novel adjustment assembly of the present invention, whereas the adjustment mechanism locks itself after selective adjustment. Moreover, a user can unlock, adjust, and lock the locking mechanism by grasping the handle and applying a pulling force outwardly with one fluid motion.

A counterbalance member may be disposed in relation to the goal support assembly to provide a force which substantially counterbalances the gravitational force acting on the goal support assembly due to the weight of the basketball goal. In one presently preferred embodiment, the counterbalance member comprises a coil spring disposed in such a manner so as to draw the upper and lower engagement arms towards the basketball backboard.

Thus it is an advantage of the present invention to provide a one-handed, easily grippable height adjustment mechanism for a basketball coal assembly that is conveniently adjustable, cost effective to manufacture, and easy to assemble. It is a further advantage of the present invention to provide a height-adjustment assembly that is self-locking after being adjusted, wherein the height of the basketball goal can be precisely adjusted to one of a series of discreet settings while requiring only a minimal force.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 4, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
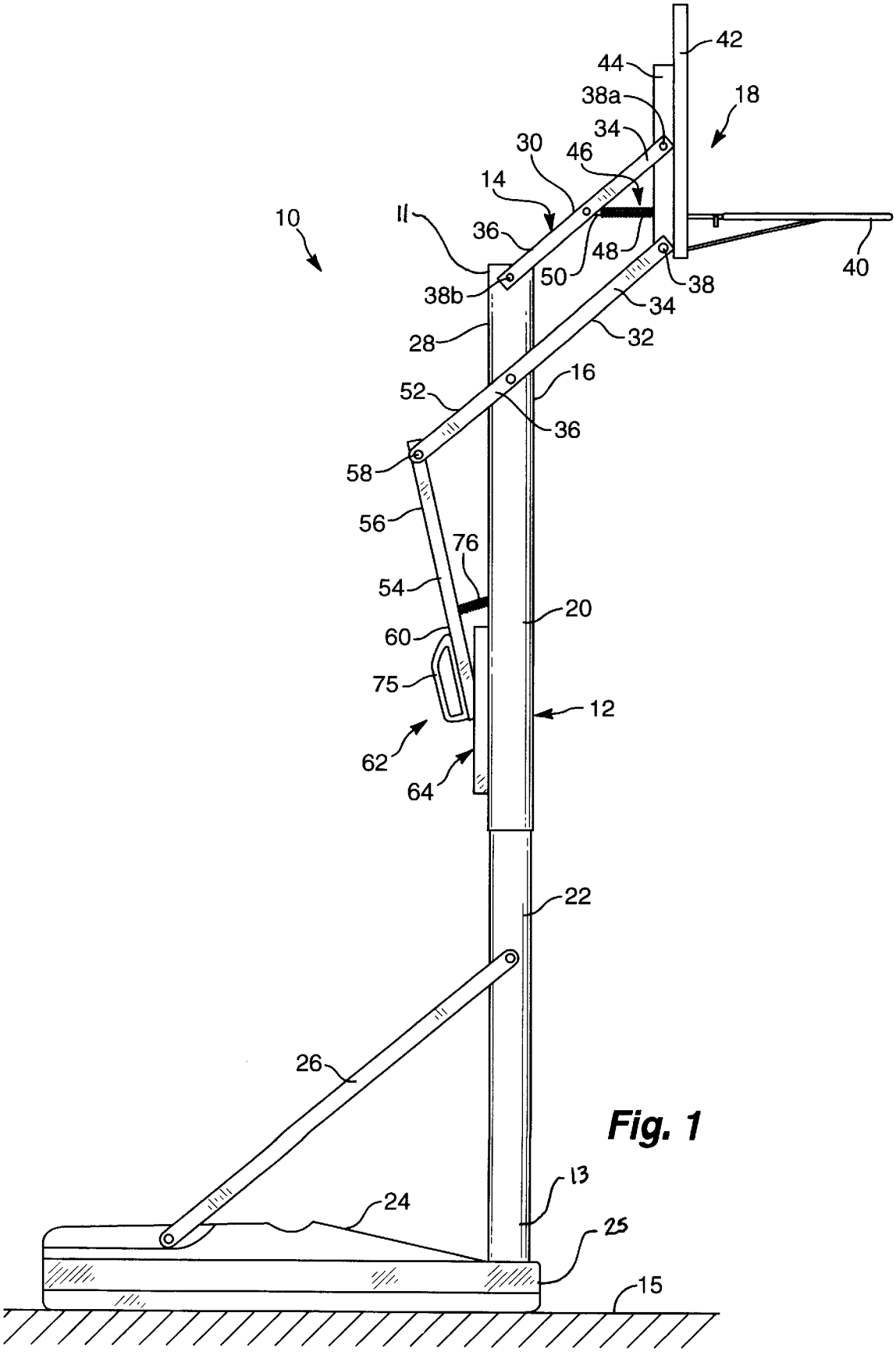
FIG. 1 is a side view of one presently preferred embodiment of a basketball goal system in accordance with the present invention.

One presently preferred embodiment of the present invention, designated generally at 10, is best illustrated in FIG. 1. As shown, the adjustable basketball goal system 10 includes a rigid support pole 12 having a first end 11 configured to supportably engage a basketball goal support assembly 14 above a playing surface 15 and a second opposing end 13 adapted to mountably engage a support base 24. Structurally, the support base 24 includes a receiving aperture formed at a front end 25 of the support base 24, wherein the receiving aperture is adapted to receive and maintain the opposing second end 13 of the support pole 12 in either a fixed or pivotal relationship. The support base 24 further provides sufficient weight so as to support the pole 12 and a goal support assembly 14 in a general upright position over a playing surface 15. In addition, one or more brace supports 26 may be adapted to provide a structural connection between the base 24 and the pole 12 so as to assist in providing structural support to retain the pole 12 and the attached goal support assembly 14 in a generally upright configuration for game play.

In one presently preferred embodiment, the goal support assembly 24 may include a backboard 42, a rim 40, a net (not shown), and upper and/or lower engagement arms 30, 32 pivotally connected between a back plate 44 of the backboard 42 and the first end 11 of the support pole 12. As illustrated in FIGS. 1–4 and contemplated herein, a quick-release, self-adjusting latch mechanisms 62 may be operably disposed in relation to the upper and/or lower engagement arms 30, 32 of the goal support assembly 14 such that selective manipulation of the adjustable latch mechanism 62 results in a corresponding adjustment in the height of the goal support assembly 14 above the playing surface 15, wherein any adjustment in the height of the goal support assembly above the playing surface directly corresponds to selective deformations. Specifically, the configuration of the goal support assembly 14 allows the backboard 42, the rim 40, and the net (not shown) to be adjusted to different selective heights while remaining horizontally disposed in relation to the playing surface 15.

Figure 2:
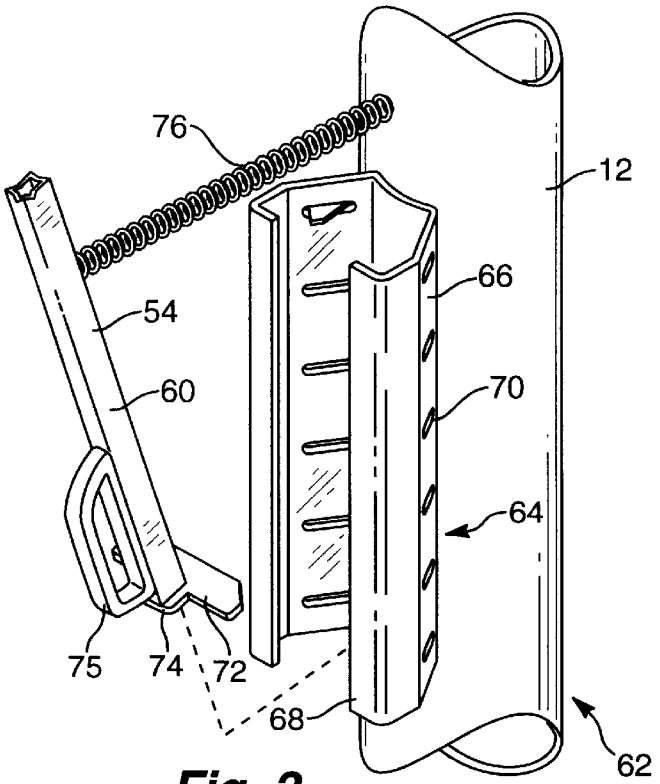
FIG. 2 is a perspective view of one presently preferred embodiment of an adjustment mechanism suitable for the embodiment of the basketball goal system illustrated in FIG. 1.
Figure 3:
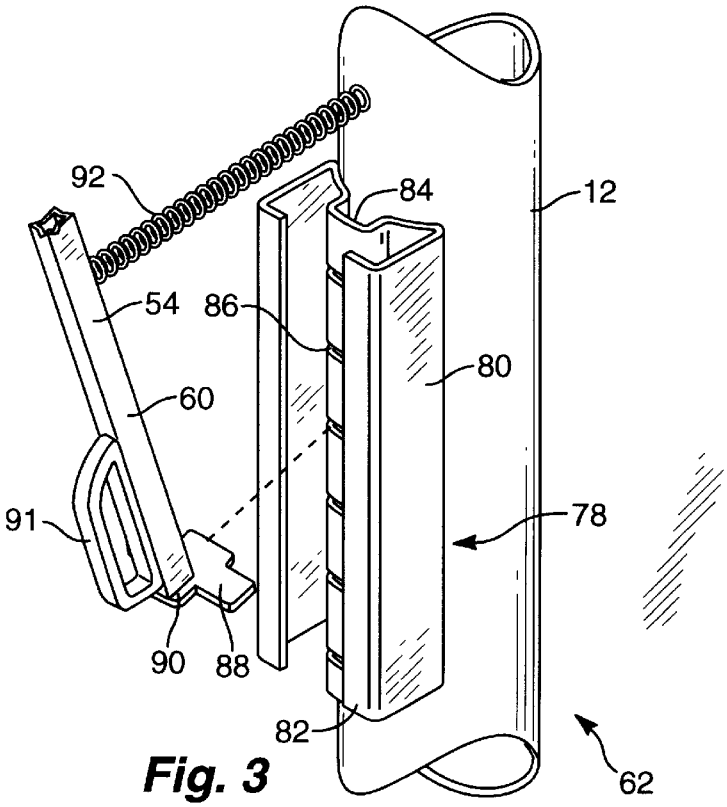
FIG. 3 is a perspective view of an alternate preferred embodiment of an adjustment mechanism suitable for the embodiment of the basketball goal system illustrated in FIG. 1.
Figure 4:
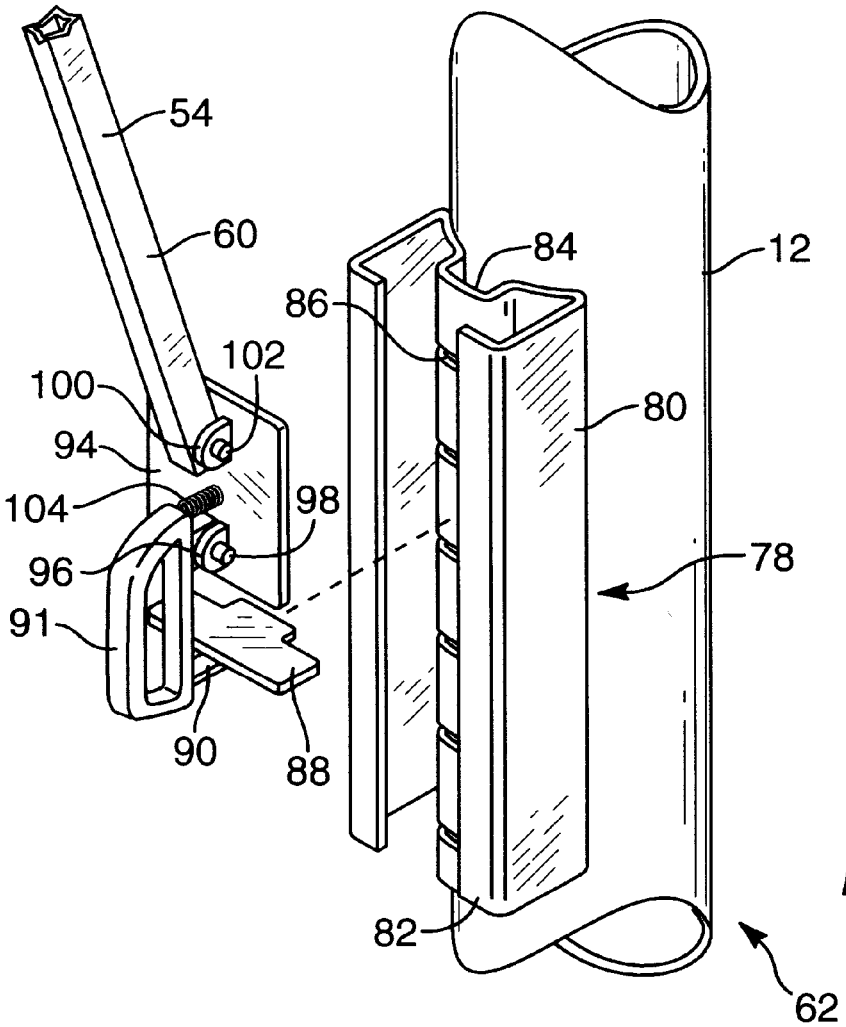
FIG. 4 is a perspective view of yet another alternate preferred embodiment of an adjustment mechanism suitable for the embodiment of the basketball goal system illustrated in FIG. 1.

An extension arm 54 is preferably disposed between the goal support structure 14 and the support pole 12. In one presently preferred embodiment, the extension arm 54 is pivotally attached at a first end 56 to an upper and/or lower engagement arm(s) 30, 32 of the goal support structure 14 and extends substantially downwardly therefrom along a back side 28 of the support pole 12. A second opposing end 60 of the extension arm 54 may be engageably disposed in relation to a track 64 having a series of slots 70 formed therein, as best illustrated in FIGS. 2–4. Preferably, the track 64 is rigidly attached at a point along the length of the back side 28 of the support pole 12. Structurally, the second opposing end 60 of the extension arm 54 comprises a locking key 72 configured to independently engage the series of slots 70 formed in the track 64 so as to provide a locking engagement therebetween. Preferably, the key 72 extends from a connector 74 affixed to the second end 60 of the extension arm 54 such that the key 72 selectively engages a pair of corresponding slots of the series of spaced-apart slots 70 formed in the track 64 which is rigidly attached along the back side 28 of the support pole 12. The series of slots 70 provide a series of discreet settings for adjusting the height of the basketball goal 18 above the playing surface 15. A user can therefore determine the selected height of the basketball goal 18 by simply checking to see which slot or corresponding slots 70 engageably retain the key 72 in mating relationship.

In one presently preferred embodiment, the deformable goal support assembly 14 has a lower engagement arm 32 pivotally fixed at the first end 11 of the support pole 12. A leveraging extension of the lower engagement arm 32 extends rearward from the support pole 12 to pivotally connect to the first end 56 of the extension arm 54. Thus, an adjustment in the vertical displacement of the extension arm 54 relative to the locking engagement between the key 72 and slots 70 formed in the track 64 are translated through the lower engagement arm 32 to the goal support assembly 14. The goal support assembly 14 is thereby deformed, thus altering the height of the basketball goal 18 in relation the playing surface 15. Similarly, one presently preferred method of adjusting the height of the basketball goal support assembly 14 may comprise the steps of: (1) gripping a handle 75 preferably attached at the second end 60 of the extension arm 54; (2) pulling on the handle 75 in a direction away from the back side 28 of the support pole 12 to dislodge the engaging key 72 from the slot or corresponding slot 70; (3) slidably positioning the key 72 adjacent to the desired slot(s) 70; and (4) releasing the handle 75 thereby introducing the key 72 into a slot 70 in the track 64 and thereby locking the extension arm 54 in a selectively fixed position relative to the support pole 12 and the goal support assembly 14.

Preferably, the adjustable basketball goal assembly 10 of the present invention may be self-adjusting because once the handle 75 attached to the extension arm 54 is released, the key 72 slides into the first available slot 70 formed in the track 64. In this regard, a biasing member 76, 92 (i.e., a spring) is preferably attached between a portion of the extension arm 54 and the rigid support pole 14 so as to facilitate a biasing force acting therebetween, as best shown in FIGS. 1–3.

More specifically, in one presently preferred embodiment, a coal support assembly 14 is disposed in relation to the rigid support pole 12 adjacent a goal side 16 of the pole 12. A basketball goal 18 is attached to the goal support assembly 14 opposite the back side 28 of the support pole 12. In the depicted embodiment, the goal support assembly 14 is preferably parallelogramic in shape and selectively deformable into a plurality of defined positions. At each position, the basketball goal 18 is disposed at a different height above the playing surface 15.

In one presently preferred embodiment, the rigid support pole 12 may include an upper pole section 20 to which the goal support structure 14 is attached, and a lower pole section 22 which telescopically disposed in relation to the upper section 20. For example, the lower pole section 22 may be press fit into the upper pole section 20 or vice versa. As will be appreciated, this configuration may be utilized to make the adjustable basketball goal system 10 easier and more cost effective to package and store.

As best shown in FIG. 1, the lower pole section 22 may be disposed in relation to a support base 24 wherein the base may include a receiving aperture for receiving and retaining the second end 13 of the support pole 12 in a generally upright position. The support base 24 may include means for allowing mobility from one location to another or, in the alternative, have a stationary configuration. Additionally, the support base 24 may comprise an internal cavity sufficient for receiving and selectively retaining a ballast material (e.g., water, sand, or the like) to support and stabilize the adjustable basketball goal assembly 10 above the playing surface 15 for game play.

The goal support assembly 14 of the adjustable basketball goal assembly 10 comprises an upper linkage arm 30 and a lower linkage arm 32. The upper and lower linkage arms 30, 32 each have a proximal end 34 and a distal end 36. In one presently preferred embodiment, the proximal ends 34 of the upper and lower arms 30, 32 are pivotally attached to a backing plate 44. The backing plate 44 is preferably disposed behind the backboard 42. Moreover, the basketball goal 18 comprises a rim 40 extending longitudinally outward from the front of the backboard 42 in a generally perpendicular configuration.

The proximal ends 34 of the upper and lower linkage ore engagement arms 30, 32 may be pivotally attached to the back plate 44 by fasteners 38*a* (e.g., bolts, screws, rivets, or the like) positioned through openings formed within the backing plate 44. The distal ends 36 of the upper and lower linkage arms 30, 32, respectively, may be pivotally attached to the support pole 12 by fasteners 38*b* (e.g., bolts, screws, rivets, or the like) positioned through openings formed at the first end 11 of the support pole 12. It will be appreciated, a variety of conventional fasteners or fastening methods may be utilized to pivotally attach the upper and lower engagement arms 30, 32 between the back plate 44 of the backboard 42 and the support pole 12. Because the upper linkage arm 30 and the lower linkage arm 32 are pivotally mounted at each end 34, 36, the parallelogramic goal support assembly 14 may be deformed to reposition the height of the basketball goal 18 while allowing the backboard 42 to remain generally vertically disposed and the rim 40 to remain horizontally disposed at all times.

In one presently preferred embodiment, the weight of the goal support assembly 14 is counterbalanced with a resistive biasing member 46. Structurally, the resistive biasing member 46 provides a force which substantially counterbalances the gravitational force acting on the goal support assembly 14 by virtue of the weight of the basketball goal 18. In one presently preferred embodiment, the resistive member 46 comprises a coil spring having sufficient rigidity and stiffness to adequately resist the weight of the basketball goal 18. The spring 46 is preferably attached at a proximal end 48 to the backing plate 44 and at a distal end 50 to the upper linkage arm 30 of the goal support assembly 14. The counterbalancing force provided by the resistive biasing member 46 allows for adjustment of the height of the basketball goal 18 above the playing surface 15 with minimal effort exercised by a user.

It will be appreciated by those skilled in the art that many different methods could be employed to sufficiently counterbalance the goal support assembly 14. Similarly, a plurality of mechanisms may be utilized to provide resilient force tending to counteract the force of gravity acting on the basketball goal 18. For example, linear springs, torsional springs, leaf springs, pneumatic pistons, magnets, and weights can be used in combination with levers, pulleys, cams, and other mechanical elements. These mechanisms may be disposed in relation to the goal support assembly 14, the basketball goal 18, the support member 12, the extension arm 54, the support base 24, or some combination thereof.

In one presently preferred embodiment, at least one of the linkage arms 30, 32 includes a leveraging extension 52 which extends beyond the distal end 36 thereof and substantially outward from a back side 28 of the rigid support member 12. In preferred structural design, the leveraging extension 52 is an integral part of the lower linkage arm 32. The leveraging extension 52 provides a leveraged point from which to adjust the height of the basketball goal 18 In operation, exerting a downward force on the leveraging extension 52 deforms the goal support assembly 14 in such a manner as to raise the basketball goal 18 in relation to the playing surface. Conversely, allowing the leveraging extension 52 to rise upward deforms the goal support assembly 14 so as to lower the height of the basketball goal 18 in relation to the playing surface.

As discussed above, an extension arm 54 is pivotally connected at a first end 56 to the leveraging extension 52 by a fastener 58 (e.g., bolt, screw, rivet, or the like). The length of the leveraging extension 52 is determined by the desired degree of leverage transmitted through the goal support assembly 14 to the basketball goal 18. A second end 60 of the extension arm 54 terminates in an adjustment mechanism 62 which selectively engages a track 64 rigidly attached to a portion of the length of the support pole 12. Vertical movement of the second end 60 of the extension arm 54 along the back side 28 of the support member 12 correspondingly raises or lowers the leveraging extension 52, thereby altering the height of the basketball goal 18 in relation to the playing surface 15.

Alternatively, the adjustment mechanism 62 can be configured to permit attachment of the extension arm 54 at a series of points to a fixed point on the support pole 12. Thus, the adjustment mechanism 62 may function by permitting a fixed point on the extension arm 54 to slide along the support pole 12, or by permitting a fixed point on the support pole 12 to slidably engage the extension arm 54. However, in the presently preferred embodiments described herein, a fixed point on the extension arm 54 slides along the support pole 12.

Referring now to FIG. 2, the adjustment mechanism 62 is illustrated in greater detail. A track 64 is rigidly mounted to the support member 12. The track 64 comprises an outer wall 66, a lip 68, and a plurality of slots 70. A key 72 is held in the track 64 (as shown by the dashed line) by the outer wall 66, which keeps the key 72 centered within the track, and the lip 68, which keeps the key 72 close to the slots 70. The configuration of the slots 70, as shown, is not intended to be restrictive but rather illustrative of one presently preferred embodiment of the present invention. In this regard, the slots 70 formed in the track 64 may comprise any type of indentation shaped to restrain motion in one direction. Similarly, the key 72 may be formed having any shape or configuration sufficient for enabling ready engagement of the key 72 within a slot or corresponding pair of slots 70. The key 72, the track 64, the handle 75, the connector 74, and the extension arm 54 can be manufactured from any material having suitable strength and rigidity, including metals, plastics, ceramic-based materials, and composites.

As best shown in FIG. 2, the key 72 may be affixed to the second end 60 of the extension arm 54 by a connector or spacer 74. The connector 74 may be formed as an integral portion of the extension arm 54, an integral portion of the key 72, or as a separate member. Preferably, a handle 75 is mounted at the second end 60 of the extension arm 54. A resilient biasing member 76, preferably a spring, may be attached between the extension arm 54 and the support member 12 to bias the extension arm 54 towards the support member 12. The use of the biasing member 76 effectively biases the key 72 into the slots 70 of the track 64. A resilient member 76 could also take the form of a system utilizing linear springs, torsional springs, leaf springs, pneumatic pistons, magnets, weights, levers, pulleys, cams, or other mechanical elements. In operation, the key 72 is shaped so as to engage the slot or corresponding slots 70 formed in the track 64 when urged towards the support pole 12, and to selectively slide past the slots 70, moving against the lip 68, when pulled a distance away from the support pole 12 thereby removing the engaging relationship between the key 72 and the slots 70.

Utilizing the quick-release, self-adjusting mechanism 62 of the present invention, a user may easily adjust the height of the goal support assembly 14 using only a single hand while standing on the playing surface 15. Pulling the handle 75 away from the support pole 12 releases the locking key 72 from the corresponding engaging slots 70, thereby permitting the key 72 to move vertically within the track 64. In one presently preferred embodiment, vertical movement of the key 72 is accomplished by moving the handle 75 up or down. Upward motion of the key 72 is transmitted through the extension arm 54 and into the leveraging extension 52 of the lower linkage arm 32. The leveraging extension 52 moves upward while the proximal end 34 attached to the basketball goal 18 moves downward. As a result, the height of the basketball goal 18 above the playing surface 15 increases. Conversely, downward motion of the key 72 increases the height of the basketball goal 18 in relation to the playing surface 15.

When the basketball goal 18 is at a selected position, the handle 75 is released. The biasing spring 76 then encourages the locking key 72 towards the corresponding slots 70 in the track 64. If the key 72 is aligned with one of the slots 70, it slips into engagement with that slot. However, if the key 72 is positioned between the slots 70, it will move up or down to engage the first available slot. The force exerted by the counterbalance spring 46 may have an effect on determining whether the locking key 72 moves up or down within the internal periphery of the track 64. If the counterbalance spring 46 provides a force greater than is required to fully overcome the weight of the basketball goal 18, the key 72 will slide downward. Otherwise, the key 72 slides upward. In either case, the adjustment mechanism 62 is self-adjusting because it returns to a locked position by default. Similarly, the counterbalance spring 46 provides sufficient force to permit easy movement of the key 72 within the track 64 when the key 72 is digengaged from the slots 70.

Even if the key 72 is inadvertently impacted and temporarily released, the goal support assembly 14 will be allowed to move only slightly or not at all. After the impacting force is terminated, the biasing spring 76 will cause the locking key 72 to selectively engage the first of the slots 70 with which it comes into alignment, restricting any further movement. Also, the counterbalancing force of the spring 46 generally prevents the basketball goal 18 from moving through any significant unexpected displacement.

Referring now to FIG. 3, an alternate embodiment of the adjustment mechanism 62 is further illustrated. As shown, a track 78 rigidly mounted to the support pole 12 and including an outer wall 80 and a lip 82. The track 78 is preferably formed having a ridge 84 protruding substantially inward between two side walls 80 and away from the support pole 12. A plurality of engaging slots 86 may be formed in the ridge 84 rather than in the side walls 80 of the track 78. Accordingly, a key 88 is configured having a shape sufficient to engage the corresponding slots 86. A connector or spacer 90 may also be provided to attach the key 88 to the second end 60 of the extension arm 54.

As with the embodiment of the adjustment mechanism 62 shown in FIG. 2, a user can pull a handle 91 to remove the locking key 88 from engagement with the slots 86 formed in the track 78. The locking key 88 can then be vertically moved within the internal periphery of the track 78 so as to align the key 88 with a new corresponding slot 86. A resilient biasing member 92, preferably a spring, urges the key 88 into one of the slots 86 in the absence of an opposing force. The resilient biasing member 92, like the resilient member 76 of FIG. 2, may be formed by any number of mechanical systems designed to ultimately exert force on the key 88.

FIG. 4 illustrates yet another alternate embodiment of the extension arm 54 and adjustment mechanism 62 of the adjustable basketball goal assembly 10 of the present invention. As shown, the key 88 is not rigidly attached to the extension arm 54, but is affixed directly to the handle 91 by a connector or spacer 90. The handle 91 is pivotally attached to a base plate 94 by a bracket 96 and pivot pin 98. The extension arm 54 is also pivotally attached to the base plate 94 by a similar bracket 100 and pivot pin 102. A resilient member 104, preferably a spring disposed in compression, urges an upper portion of the handle 91 away from the base plate 94. As with the resilient biasing members 76 and 92 shown in FIGS. 2 and 3, the resilient member 104 call be embodied in a wide variety of mechanical systems designed to ultimately exert a biasing force on the key 88. A lower portion of the handle 91 is, in turn, urged towards the track 78 and acts to encourage the locking key 88 into the corresponding slots 86.

In one presently preferred embodiment, the base plate 94 is thus configured to fit within the internal periphery of track 88 and slide vertically along with the locking key 88. This embodiment is advantageous in that the key 88 and the handle 91 are held at a constant angle during adjustment. With previous embodiments outlined herein, the key 72, 88 selectively engage the corresponding slots at a different angle of attack as the key 72, 88 moves from one slot to the next in either direction. This occurs because the extension arm 54 reaches the track 64, 78 at a different angle depending on the height of the leveraging extension 52.

Thus, when the key 72, 88 is rigidly attached to the extension arm 54, the slots 70, 86, respectively, must be either individually angled to align with the key, or properly toleranced to accommodate various angles of engagement. The alternate preferred embodiment illustrated in FIG. 4 has no such necessity because the key 88 engages each of the slots 78 with the same angle of engagement. Since the biasing spring 104 moves with the base plate 94 and key 88, a consistent force is provided to thereby urge the key 88 into one of the corresponding slots 86. Thus, the handle 91 remains at a constant angle during engaging adjustment.

In this manner, the height of the basketball goal 18 may be adjusted without the aid of a separate adjustment pole, ladder, or the like. Further, with the adjustment mechanism 62 located on the back side 28 of the rigid support member 12, the adjustment mechanism 62 is less likely to interfere with game play or be struck by a stray ball. The adjustment mechanism 62 may, however, be affixed to the goal side, 16 of the support member 12 for convenience, if desired. In such case, the extension arm 54 would be pivotally attached to the lower linkage arm 32 between the distal end 36 and the proximal end 34, instead of to the leveraging extension 52. Operation of the adjustment mechanism 62 would therefore be similar to that described above, except that moving the handle 75, 91 upward would raise the basketball goal 18 instead of lowering it.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An adjustable basketball goal system allowing for adjustment of the height of a basketball goal above a playing surface, comprising:

a support member having a plurality of engaging slots;

a goal support structure disposed in relation to said support member, said goal support structure being deformable into a plurality of configurations wherein at each configuration said basketball goal is disposed at a different height above said playing surface;

an extension arm having a first end and a second opposing end, said first end attached to said goal support structure and said second end engageably disposed in relation to said support member, wherein movement of said extension arm selectively deforms the goal support structure;

a locking mechanism operably disposed relative to said extension arm, said locking mechanism having an engaged position wherein restricting said goal support structure from deforming and a disengaged position wherein the goal support structure is deformable; and wherein said locking mechanism comprises a key selectively disposable in relation to said plurality of slots formed in said support member.

2. The adjustable basketball goal system defined in claim 1, wherein said deformable goal structure is substantially parallelogramic in configuration.

3. The adjustable basketball goal system defined in claim 1, wherein said slots are vertically arrayed to provide a series of anchor points for attachment of said extension arm to said support member.

4. The adjustable basketball goal system as defined in claim 3, wherein said key is attached to said second end of the extension arm.

5. The adjustable basketball goal system as defined in claim 4, further comprising a track mounted to said support member for maintaining said key in alignment with said slots.

6. The adjustable basketball goal system as defined in claim 5, wherein said slots are formed in the track.

7. The adjustable basketball goal system as defined in claim 6, further comprising a spring for biasing said key into said slots.

8. The adjustable basketball goal system as defined in claim 7, further comprising a base plate slidable within said track, pivotally attached to said extension arm, and pivotally attached to said key, for maintaining the key at a pitch selected to ensure proper engagement with said slots.

9. The adjustable basketball goal system as defined in claim 1, wherein said key is attached to said support member to permit adjustable anchoring of said second end of said extension arm to the support member.

10. An apparatus comprising an adjustable basketball goal assembly, the apparatus comprising:

a support member;

a goal support structure disposed in relation to said support member, said goal support structure being deformable into a plurality of configurations wherein at each configuration said basketball goal is disposed at a different height above said playing surface;

an extension arm having a first end and a second opposing end, said first end attached to said goal support structure and said second end engageably disposed in relation to said support member, wherein movement of said extension arm selectively deforms the goal support structure;

a locking mechanism operably disposed relative to said extension arm, said locking mechanism having an engaged position wherein restricting said goal support structure from deforming and a disengaged position wherein the goal support structure is deformable;

a track rigidly attached to said support member and comprising a plurality of engaging slots; and wherein said locking mechanism comprises a key selectively disposable in relation to said plurality of slots formed in said track.

11. The adjustable basketball goal system defined in claim 10, wherein said deformable goal structure is substantially parallelogramic in configuration.

12. The adjustable basketball goal system defined in claim 10, wherein said slots are vertically arrayed to provide a series of anchor points for attachment of said key and said extension arm in relation to said support member.

13. The adjustable basketball goal system as defined in claim 12, wherein said key is attached to said second end of the extension arm.

14. The adjustable basketball goal system as defined in claim 10, further comprising a spring for biasing said key into said slots.

15. The adjustable basketball goal system as defined in claim 10, further comprising a base plate slidable within said track, pivotally attached to said extension arm, and pivotally attached to said key, for maintaining, the key at a pitch selected to ensure proper engagement with said slots.

16. The adjustable basketball goal system as defined in claim 10, wherein said key is attached to said support member to permit adjustable anchoring of said second end of said extension arm to the support member.

17. A method for adjusting the height of a basketball goal assembly at any one of a plurality of configurations such that the basketball goal is suspended above a playing surface, the basketball goal assembly comprising a basketball goal attached to a goal support structure secured to a support member, an extension arm having a first end connected to said goal support structure and a second opposing end operably connected to the support member, and an adjustment mechanism comprising a key selectively disposable in relation to a plurality of slots formed in relation to the support member, the method comprising the steps of:

disposing said adjustment mechanism in a disengaged position wherein said goal support structure is deformable;

deforming said goal support structure while maintaining said adjustment mechanism in said disengaged position; and disposing said adjustment mechanism in an engaged position wherein restricting said goal support from deforming.

18. The method for adjusting the height of a basketball goal assembly as defined in claim 17, wherein deforming the goal support structure comprises moving said key into alignment with one of said plurality of slots.

19. An adjustable method for a basketball goal assembly as defined in claim 17, wherein said adjustment mechanism comprises a biasing member disposed to urge the adjustment mechanism into said engaged position.

20. An adjustable method for a basketball goal assembly as defined in claim 17, wherein said adjustment mechanism comprises a gripping surface adapted to permit gripping and selective adjustment by a single hand of a user.

* * * * *